United States Patent [19]

Cappotto

[11] 4,337,001

[45] Jun. 29, 1982

[54] RELEASABLE RIBBON LOCKING DEVICE IN A RIBBON CARTRIDGE

[75] Inventor: Samuel D. Cappotto, Syracuse, N.Y.

[73] Assignee: SCM Corporation, New York, N.Y.

[21] Appl. No.: 172,624

[22] Filed: Jul. 28, 1980

[51] Int. Cl.[3] ..... B41J 33/14

[52] U.S. Cl. ..... 400/208; 400/234; 242/75.43; 242/197

[58] Field of Search ..... 400/207, 208, 234; 242/75, 43, 156, 156.1, 156.2, 197, 198, 199, 200

[56] References Cited

U.S. PATENT DOCUMENTS

| | | | |
|---|---|---|---|
| 1,469,284 | 10/1923 | Strawn | 242/75.43 |
| 1,952,196 | 3/1934 | Coil | 242/75.43 |
| 3,442,366 | 5/1969 | Spears | 400/234 |
| 3,528,536 | 9/1970 | Caudill et al. | 400/234 X |
| 3,643,779 | 2/1972 | Anderson et al. | 400/208 X |
| 3,764,438 | 10/1973 | Voss et al. | 242/75.43 X |
| 4,010,839 | 3/1977 | Guerrini et al. | 400/207 |
| 4,074,799 | 2/1978 | Hishida et al. | 400/208 |

*Primary Examiner*—Ernest T. Wright, Jr.

*Attorney, Agent, or Firm*—William E. Mear; Ernest F. Weinberger

[57] ABSTRACT

A releasable ribbon locking device is used to keep a ribbon taut in a typewriter ribbon cartridge. The device includes a locking member carrying a blade or brake urged by a spring into abutting relationship with a rotatable ribbon supply support to prevent unwinding of fresh ribbon from the supply. A lock release member is movably coupled to the locking member and supports a ribbon tensioning element in engagement with a portion of the ribbon extending from the ribbon supply. In operation, a ribbon feed mechanism pulls on the ribbon which moves the lock release member through the tensioning element and correspondingly moves the locking member to rotatably free the ribbon supply support from abutment with the brake and allows the ribbon to unwind from the supply. Upon completion of the ribbon feed operation, the spring operates to move the brake against the supply support for preventing indiscriminate unwinding of the ribbon and to move the tensioning element so as to continually engage the ribbon in order to maintain it taut in the cartridge.

4 Claims, 5 Drawing Figures

RELEASABLE RIBBON LOCKING DEVICE IN A RIBBON CARTRIDGE

BACKGROUND OF THE INVENTION (1) Field of the Invention

The present invention relates to ribbon tensioning devices and more particularly to a releasable ribbon locking device operable in a ribbon cartridge for maintaining an exposed spanwise portion of the ribbon in a taut or non-sagging condition.

(2) Description of the Prior Art

In the field of ribbon tensioning devices contained in a removable ribbon cartridge, it is a primary concern that the ribbon remain in a relatively taut condition at all times whether the cartridge is operatively positioned in a printing machine or removed therefrom, say for storage. A taut ribbon provides a true straight-line portion of the ribbon in spanning a print gap of the cartridge that exposes ribbon external from a protective housing. Thus, cartridges equipped with a ribbon tensioning device are easily and quickly interchangeable without concern that the exposed portion of the ribbon may snag or rub members in the printing machine such as a printing element, a print indicator or a ribbon guide located near the cartridge changing path. Also, in using the cartridge in the machine, the ribbon should remain taut so as to avoid contact with proximal members during vibratory motion, minimize the possibility of the ribbon becoming entangled in the cartridge and enable a ribbon feed mechanism to accurately advance the ribbon the prescribed amount.

Heretofore many ribbon cartridges employing a form of a ribbon tensioning device have been developed. The prior art fails to disclose a ribbon tensioning device that satisfies all the conditions for keeping a ribbon continually taut. For example, U.S. Pat. No. 4,074,799, granted Feb. 21, 1978 to Hishida et al discloses a ribbon cartridge with a ribbon slack prevention device that is only operable for keeping the ribbon taut when the cartridge is removed from the typewriter. Another example of a ribbon cartridge having a ribbon tensioning device is U.S. Pat. No. 4,010,839 granted Mar. 8, 1977 to Guerrini et al. In Guerrini et al, the disclosed ribbon tensioning device operates using a detent pin that engages notches on a feed spool in order to prevent chance unwinding of the ribbon. The problem in using the detenting system for ribbon tensioning purposes is that the operative range for properly holding the ribbon is restricted to rotation of the feed spool in amounts defined by the fixed notched spacing. It can be appreciated by one skilled in the art that rotation of the feed spool for a given ribbon advancement will vary in amounts depending on the diameter of the ribbon wound thereon. Accordingly, the detent pin is not precisely aligned with a notch for all ribbon feed advancements and as a result affects the ribbon tautness.

SUMMARY OF THE INVENTION

The present invention avoids the problems and disadvantages of the prior art by providing a releasable ribbon locking device used in a ribbon cartridge that operates to keep a ribbon taut under all printing conditions and even when the cartridge is removed from the printing machine.

To attain this, the releasable ribbon locking device comprises a locking member that carries a brake blade movable between a ribbon locking position and a ribbon release position. A lock release member is movably coupled to the locking member and supports a ribbon tensioning element that engages a portion of the ribbon for moving the lock release member and the locking member in response to take-up of the ribbon.

In the ribbon locking position, the brake blade abuts a rim of a flange on a ribbon supply support through the action of a movable coupling urged by a spring connected to the lock release member as described below. As a result of this abutting relationship, the supply support is prevented from rotating in a ribbon unwinding direction thereby prohibiting movement of the ribbon carried on the supply support. Actuation of a ribbon feed mechanism pulls on the ribbon so as to move the lock release member through the engagement of the ribbon with the ribbon tensioning element. Against the urging of the spring transmitted via the lock release member and through the coupling, the locking member correspondingly moves towards the ribbon release position wherein the brake blade is removed from abutment with the rim thereby freeing the supply support for rotation and enabling the ribbon to unwind therefrom. The present invention further contemplates the rim having a uniform continuous surface to permit the arresting brake blade to be operative at any location therealong in order to accommodate all amounts of feed rotation of the supply support as they vary according to the diameter of the ribbon supply. Also, the ribbon tensioning element remains in engagement with the ribbon for all positions of the releasable ribbon locking device and in conjunction with a take-up supply being blocked (by a drive mechanism in the printing machine or frictionally held by a pressure finger) maintains the ribbon in the cartridge in a continually taut condition.

It is therefore an object of the present invention to provide a ribbon tensioning device for use in a ribbon cartridge that operates to prevent chance unwinding of fresh ribbon contained in the cartridge yet allows the ribbon to advance in response to ribbon feed take-up of the ribbon.

Another object of the present invention is to provide a releasable ribbon locking device in a ribbon cartridge operable in a printing machine and capable of keeping a ribbon taut when the ribbon is stationary and also during feed movement of the ribbon.

Still another object of the present invention is to provide a releasable ribbon locking device operable for positive holding of the ribbon supply over any varied amounts of feed rotation of the ribbon supply.

Another object of the present invention is to provide a releasable ribbon locking device contained in a ribbon cartridge removably mounted in a print machine wherein the device keeps the ribbon taut both when the cartridge is mounted in the printing machine and also when the cartridge is removed therefrom.

Other objects, features and advantages of the invention will be found in the following detailed description of a preferred embodiment as illustrated in the accompanying drawing.

DESCRIPTION OF THE PREFERRED EMBODIMENT

Figure 1:
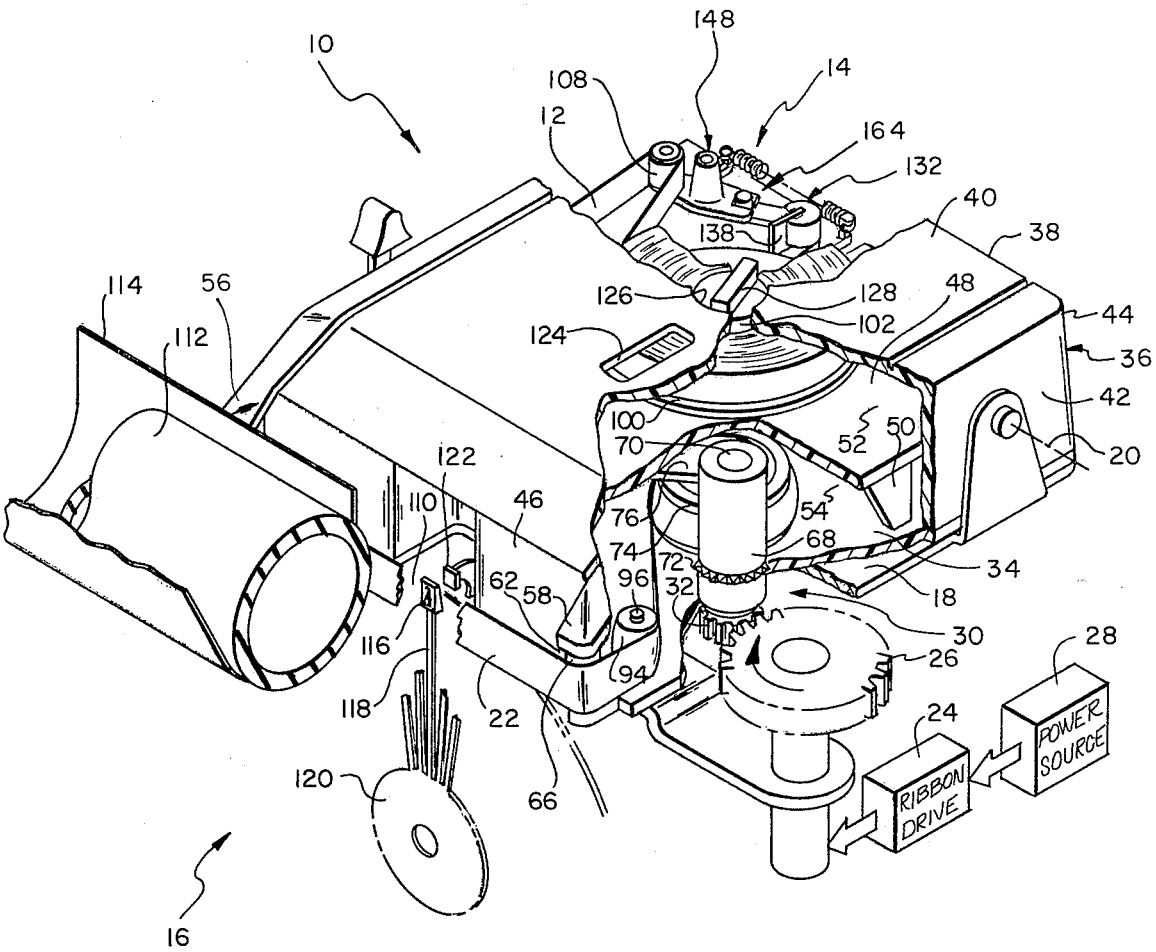
FIG. 1 is a partial rear perspective view showing a printing machine operatively supporting a ribbon cartridge employing the present invention.

Referring to FIG. 1, a ribbon cartridge 10 contains a ribbon 12 continually under tension controlled by a releasable locking device 14 built according to the present disclosure. The cartridge 10 is mounted in a printing machine, such as a typewriter 16, for pivotal motion transmitted by a pivotable cartridge support 18. The cartridge support 18 pivots about an axis 20 in order to rock the cartridge 10 thereby moving an exposed portion 22 of ribbon 12 between a lower non-printing position and the illustrated (FIG. 1) elevated printing position. Ribbon cartridge 10 is removably mountable on the cartridge support 18 that is equipped with a known latching system (not shown) to afford the cartridge 10 with a snap in/snap out interchanging action in order to enable the operator to make quick and easy changes of cartridges 10.

A ribbon drive mechanism 24 assembled in the typewriter 16 includes a gear 26 rotatably mounted on the cartridge support 18, and is operatively connected to an actuable power source 28 (e.g., a solenoid) in the typewriter 16 for selectively rotating gear 26 clockwise in feed amounts controlled by operator selection of typewriter functions, e.g., character selection used to actuate power source 28. A ribbon feed mechanism 30 in the cartridge 10 is coupled to the drive mechanism 24 through the intermeshing of a feed gear 32 with gear 26. A base 34 of the cartridge 10 rotatably supports the ribbon feed mechanism 30 with feed gear 32 located beneath base 34 for meshing with gear 26 when the cartridge 10 is snap mounted on the cartridge support 18.

The ribbon cartridge 10 comprises a housing 36 including base 34 rigidly supporting a cover 38 formed by a top 40 having integrally formed parallel side walls 42, a front wall 44 and a rear wall 46. A platform 48 has a plurality of downstanding projections 50 for level support of platform 48 intermediate and parallel to the base 34 and top 40 so as to define an upper and a lower chamber 52 and 54, respectively in housing 36. The upper chamber 52 is used to store fresh ribbon 12 and the lower chamber 54 contains spent portions of ribbon 12.

Figure 2:
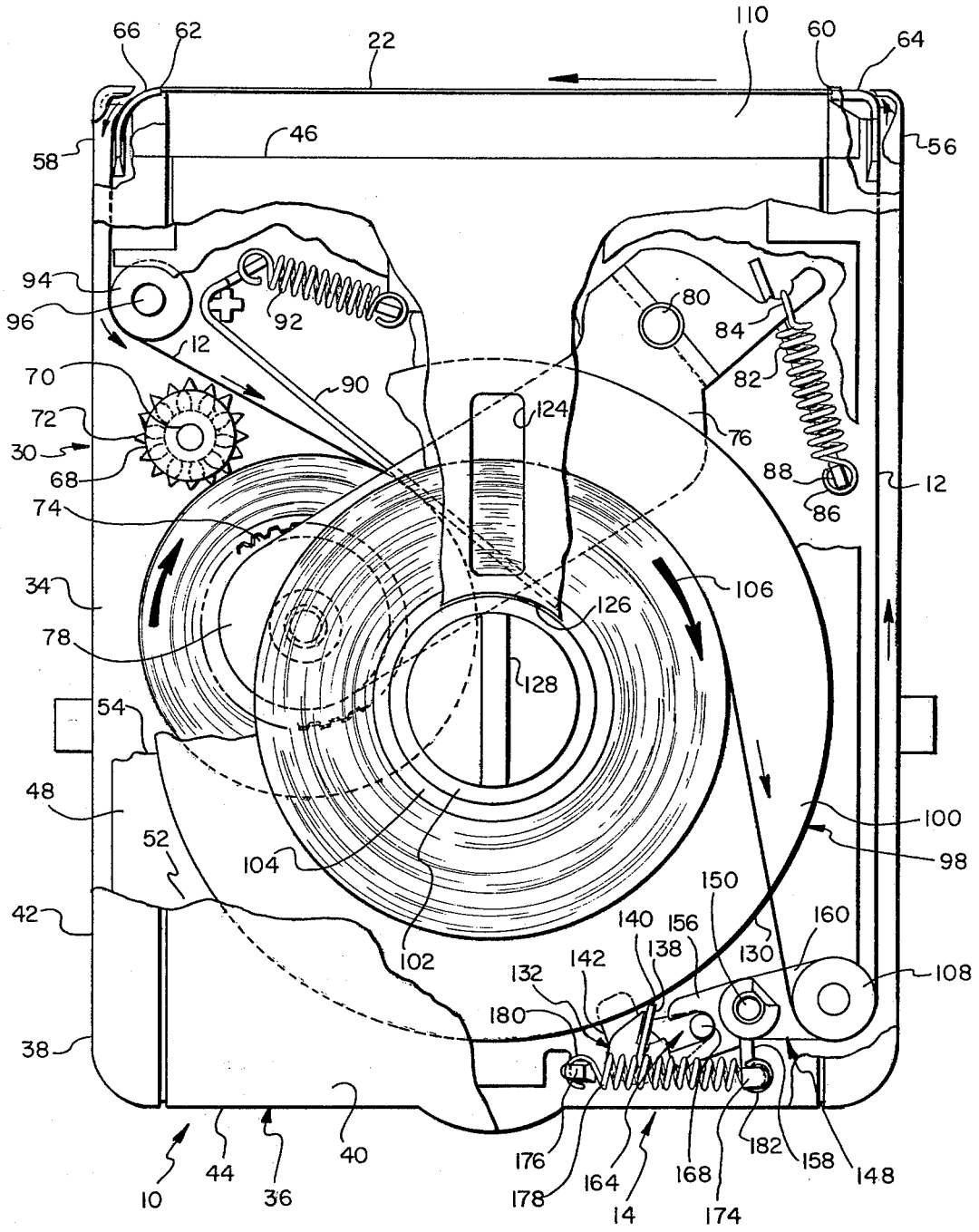
FIG. 2 is a partial top plan view of the ribbon cartridge removed from the printing machine showing the preferred embodiment of the present invention.

Referring to FIG. 2, the ribbon cartridge 10 has two hollow arms 56 and 58 extending rearwardly from housing 36 beyond the rear wall 46. Each arm 56, 58 is provided with an inward facing opening 60 and 62, for permitting passage of ribbon 12 external to housing 36. A curved, ribbon-engaging wall 64 and 66 in each arm 56 and 58 extends towards the respective opening 60, 62 for guiding ribbon 12 out through the opening 60 and back into the opening 62.

The lower chamber 54 contains a portion of the ribbon feed mechanism 30 including a feed roller 68 fixed on a rotatable shaft 70 journaled through base 34 for rotation with gear 32. A saw-toothed disc 72 is carried by feed roller 68 for engagement with ribbon 12 wound on a rotatable ribbon take-up spool 74. A bellcrank 76 is pivotally mounted on the base 34 and has an arm 78 that extends from a pivot 80 of bellcrank 76 for rotatably supporting take-up spool 74. A spring 82 is connected at one end 84 to bellcrank 76 and the other end 86 is hooked on a springmount projection 88 on base 34 for urging bellcrank 76 such that the outer wrapping of ribbon 12 on take-up spool 74 continually bears against saw-toothed disc 72. As it can be seen in FIG. 2, a build up of ribbon 12 on the take-up spool 74 pivots bellcrank 76 counter-clockwise against the pull of the spring 82.

A pressure finger 90 is pivotally mounted on base 34 and is forced by a spring 92 to continually contact the outer wrapping of the ribbon 12 at a point located just after ribbon 12 has begun to wrap onto the take-up spool 74. The purpose of the spring-loaded finger 90 is to apply a slight drag force onto the spent ribbon 12 in order to resist counter-clockwise (unwinding) rotation of the take-up spool 74 when the typewriter 16 is idle or when the ribbon cartridge 10 is removed. Also, finger 90 is used to wrap the ribbon 12 tightly as it accumulates on the take-up spool 74 without noticeably affecting feed rotation (clockwise) of the take-up spool 74.

A ribbon guide roller 94 is rotatably mounted on a post 96 extending upwardly from base 34. The guide roller 94 is positioned in the lower chamber 54 to receive ribbon 12 from wall 66 and thereafter direct ribbon 12 towards the take-up spool 74.

The upper chamber 52 contains a supply spool support 98 rotatably mounted at a location near the central portion (FIG. 2) of housing 36. The supply spool support 98 includes a flange 100 integrally extending from a hub 102 and has a ribbon supply spool 104 rigidly mounted thereon. An arrow 106 indicates the unwinding rotational direction of the supply spool support 98 for pulling ribbon 12 from the supply spool 104.

In thread winding ribbon 12 through the ribbon cartridge 10, the ribbon 12 extends from the supply spool 104 to engage partially around a ribbon tensioning element 108 in the upper chamber 52. The element 108 guides and directs it from the upper chamber 52 to the level of the lower chamber 54 and onto wall 64 of the hollow arm 56. Ribbon 12 then passes through the opening 60 to span a print gap 110 of the cartridge 10. The exposed portion 22 of ribbon 12 enters housing 36 through opening 62 onto the curved wall 66 to engage roller 94 for placement onto the take-up spool 74.

In printing operation of the described ribbon system, the ribbon cartridge 10 is elevated to the printing position of FIG. 1 wherein the exposed portion 22 of ribbon 12 is placed between a platen 112 carrying a sheet of paper 114 and a selected character 116 embossed at the end of a petal 118 of a rotatable print element 120. Printing of the selected character 116 is accomplished through a known keyboard input process which actuates a movable hammer 122. The hammer 122 moves swiftly towards the platen 112 striking the petal 118 behind the character 116 which is then carried rearward through bending of the petal 118 until the character 116 impacts the paper 114 through the ribbon 12.

A ribbon feed operation may occur just prior to or shortly after the printing operation. For a ribbon feed operation, the power source 28 is energized, e.g., through the character selection process, and rotates gear 26 clockwise, say, through the action of the ribbon drive mechanism 24. In turn, feed gear 32 is rotated, moving saw-toothed disc 72 in a counter-clockwise direction (FIG. 2). Take-up spool 74 is then rotated in a clockwise direction by virtue of the pressing engagement of the saw-toothed disc 72 biting into the outer wrapping of the ribbon 12 wound on the take-up spool 74. In this manner, the spent portion of ribbon 12 is driven to pull fresh ribbon 12 from the supply spool 104. It should be noted that the amount of feed motion applied to the take-up spool 74 is not restricted and may be in equal or proportional amounts depending on the capability of the ribbon drive mechanism 24 in conjunction with the width of the selected character 116 and the kind of ribbon 12 supplied in the ribbon cartridge 10.

The cover 38 of housing 36 is provided with a pair of apertures 124 and 126. The first aperture 124 is a rectangular configuration located above the fresh ribbon 12 supply wound on the supply spool 104 and affords visual observation of the amount of fresh ribbon 12 available on the supply spool 104. The second aperture 126 is a circular opening slightly larger in diameter than hub 102 of supply spool 104. A finger turning knob 128 is formed from hub 102 and extends through the aperture 126 above cover 38 to allow manual rotation of the supply spool support 104 in a ribbon winding direction (counter-clockwise, FIG. 2). Knob 128 thus provides the operator with a manual control which may be used to check ribbon tautness in the ribbon cartridge 10 and to tauten ribbon 12 in the event it has become slack.

DESCRIPTION OF THE INVENTION

A major concern in using the described ribbon cartridge 10 is maintaining the ribbon 12 continually in a taut condition, even in the presence of cartridge 10 vibration or shocks that may tend to slacken the ribbon 12. A taut ribbon 12 enables proper operation of ribbon feed to occur with respect to the amount of spent ribbon 12 wound onto the take-up spool 74 which equals the amount of fresh ribbon 12 pulled from the supply spool 104. In this manner, a fresh portion of ribbon 12 is always advanced the prescribed feed amount towards the printing station along print gap 110. Another reason for keeping ribbon 12 taut is to confine the exposed portion 22 of ribbon 12 to a straight line path, free from slack, along print gap 110. Keeping the ribbon 12 taut in the print gap 110 minimizes the possibility of the ribbon 12 snagging or coming into ink-removing contact with members (e.g., petals 118 of the rotatable print element 120), which are located in the typewriter 16 in close proximity to the exposed portion 22 of the ribbon 12.

Accordingly, the present invention provides a ribbon tensioning device that operates in the ribbon cartridge 10 to keep the ribbon 12 taut not only during ribbon feed operation, but also when the cartridge 10 is idle in the typewriter 16 and when removed therefrom. In the machine idle condition, the take-up spool 74 is held stationary by the ribbon feed mechanism 30 and the supply spool support 98, carrying the supply spool 104, is held by the releasable ribbon locking device 14. When the cartridge 10 is removed from the typewriter 16, each spool 74 and 104 is directly restrained from rotating in its respective unwinding direction by finger 90 and device 14 respectively. In each instance, ribbon 12 extending between the spools 74 and 104 is under a slight tension as a result of the present releasable ribbon locking device 14 having the biased tensioning element 108 engaging the ribbon 12 to apply a continual tensioning force or load on the ribbon 12. In response to take-up of the ribbon 12, caused by the pulling operation of the ribbon feed mechanism 30 in advancing ribbon 12, the present releasable ribbon locking device 14 is operated such that it frees the supply spool support 98 to allow unwinding of the ribbon 12 from the supply spool 104.

Figure 4:
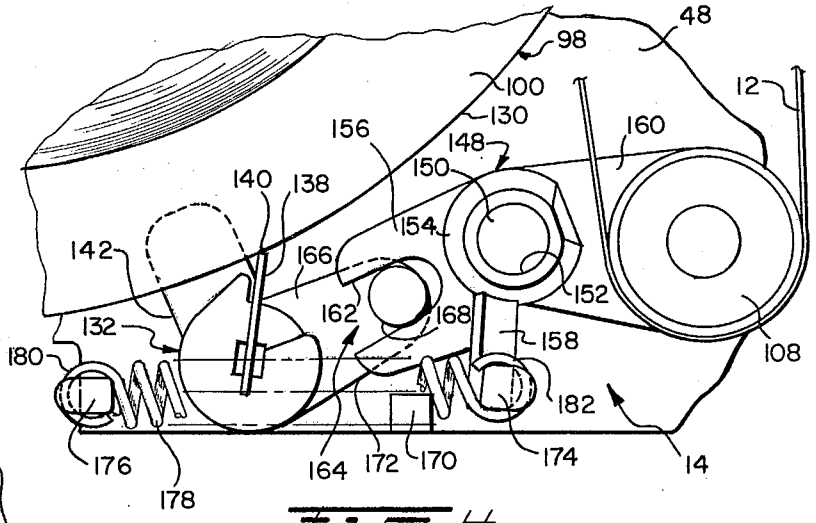
FIG. 4 is a top plan view of FIG. 3 showing the ribbon lock position of the present invention.
Figure 3:
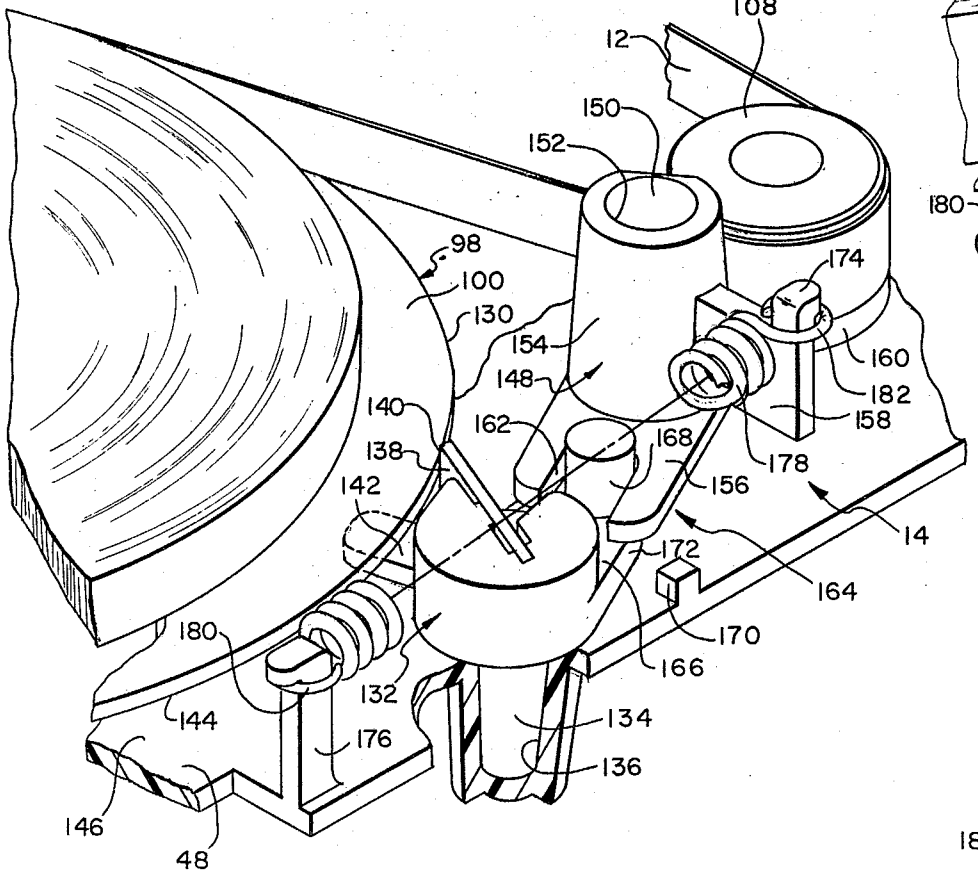
FIG. 3 is an enlarged front perspective of a releasable ribbon locking device according to the present invention.

To accomplish this, the present releasable ribbon locking device 14 provides the necessary structure so as to attain a continually taut ribbon 12 in ribbon cartridge 10. In FIGS. 3 and 4 the releasable ribbon locking device 14 is illustrated in a locking position that prevents ribbon 12 from unwinding from the supply spool 104. The releasable ribbon locking device 14 includes a smooth continuous surface on a peripheral rim 130 of flange 100 of supply spool support 98. Flange 100 has a diameter greater than that of a full supply of fresh ribbon 12 wound on the supply spool 104. A locking member 132 is movably mounted on platform 48 by having a central downstanding pin 134 closely received in a cylindrical pivot hole 136 formed in platform 48 and extend downwardly towards base 34 for permitting pivotal movement of the pin 134 and thus the locking member 132 in the pivot hole 136. A brake member, preferably in the form of a blade 138, preferably formed from a thin sheet of metallic material is firmly set edgewise in the locking member 132 and extends radially outwards from a position over the pin 134 towards abutment with rim 130. Through the pivotal action of the locking member 132, an extreme end 140 of the brake blade 138 is positionable to abut the smooth peripheral rim 130. An integrally formed finger projection 142 extends outwardly from the locking member 132 beneath flange 100 towards the central axis of the supply spool support 98. Finger projection 142 moves with the locking member 132 and is vertically confined between a bottom surface 144 of flange 100 and a top surface 146 of platform 48. In this manner, projection 142 functions to substantially limit the vertical motion of locking member 132 in order to assure abutting vertical alignment between the end 140 of blade 138 and rim 130.

A lock release member 148 is movably mounted on a pivot post 150 extending upwardly from platform 48 and received through an aperture 152 of a central hub 154 of the lock release member 148. Three projections 156, 158 and 160 are formed on the lock release member 148 and each extends outwardly from the central hub 154.

Figure 5:
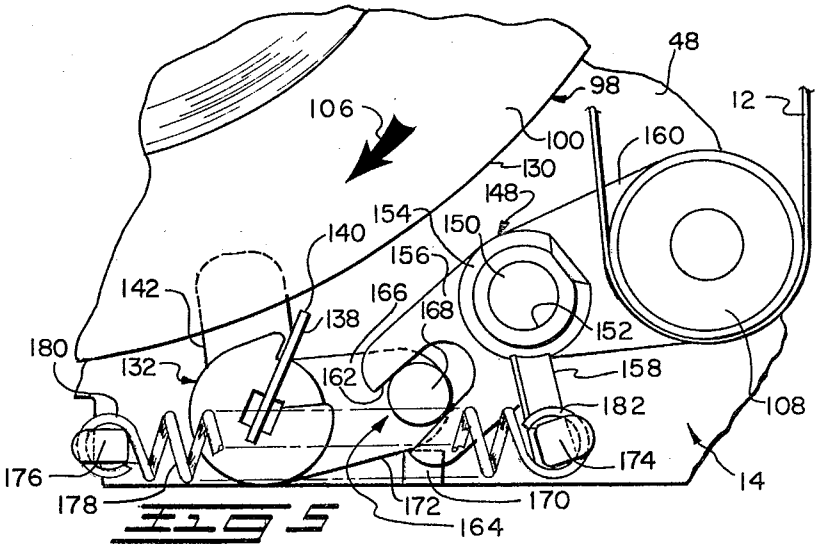
FIG. 5 is a view similar to FIG. 4 showing the ribbon release position of the present invention.

The first projection 156 extends towards locking member 132 and has an open-end slot 162 that forms a portion of a slotted bellcrank coupling 164 to pivotally connect lock release member 148 to locking member 132. The slotted bellcrank coupling 164 includes an arm 166 on the locking member 132 extending towards lock release member 148 beneath the first projection 156. A pin 168 is rigidly supported on arm 166 and is closely received through the open-end slot 162. Accordingly, pivotal motion of the lock release member 148 produces concomitant pivotal motion of locking member 132 in an opposite direction through the slotted bellcrank coupling 164. The pivotal motion of the locking member 132 is limited in each direction. Abutment of the extreme end 140 of brake blade 138 with rim 130 of flange 100 limits the counterclockwise (FIG. 3) motion of the locking member 132 in the locking position. An abutment 170 projects upwardly from platform 48 and is positioned so as to contact a side edge 172 of arm 166 for limiting pivotal motion of the locking member 132 in a clockwise direction that defines a fully released position of the releasable ribbon locking device 14, as shown in FIG. 5.

Referring to FIG. 3, the second projection 158 of lock release member 148 is provided with a spring-mounting hook-shaped finger 174. A spring-mounting post 176 extends upwardly from platform 48 and is positioned near the locking member 132. A coiled extension spring 178 has one end 180 looped on the fixed post 176 and has its other end 182 looped on hook finger 174 of lock release member 148. Spring 178 biases the lock release member 148 to urge the locking member 132 counter-clockwise towards the locking position in which the end 140 of brake blade 138 abuts rim 130. In this locking position, the spring 178 is slightly extended so as to apply a continual abutting force between brake blade 138 and flange 100.

The third projection 160 of the lock release member 148 rigidly supports ribbon tensioning element 108 that functions as a capstan for continually engaging the ribbon 12. As previously mentioned, fresh ribbon 12 extends from the supply spool 104 and is wound partially about capstan 108 for changing the direction of the ribbon 12 towards the opening 60. It should be noted that over-tensioning of the ribbon 12, e.g., take-up winding of ribbon 12 upon actuation of the ribbon drive mechanism 24, causes the lock release member 148 to pivot counter-clockwise and through the slotted bellcrank coupling 164, thereby moves the locking member 132 clockwise towards the fully released position where it contacts abutment 170.

In the locking position of FIGS. 3 and 4, the ribbon feed mechanism 30 is in a machine idle period causing flange 100 to be arrested as a result of spring 178 urging the end 140 of brake blade 138 into a pressing relationship in abutment with the continuous rim 130. In this manner ribbon 12 is prevented from unwinding from the attached supply spool 104. Also, the ribbon situated between the spools 74 and 104 is under a slight continual tension by virtue of a loop of the ribbon 12 engageably bearing against the capstan 108. This tension establishes a threshold level above which one must go to unwind fresh ribbon 12.

To move the releasable ribbon locking device 14 towards the released position of FIG. 5, ribbon feed mechanism 30 is actuated, causing gear 26 to rotate clockwise (FIG. 1) which in turn rotates the saw-toothed disc 72 counter-clockwise. This action applies a turning moment on the outer wrapping of ribbon 12 already wound on the take-up spool 74 for effecting tight winding of additional ribbon 12 onto the take-up spool 74. On feed winding ribbon 12, tension therein increases and through the engagement of ribbon 12 bearing against capstan 108 pivots the lock release member 148 counter-clockwise against the urging of spring 178. The slotted bellcrank coupling 164 moves the locking member 132 towards abutment 170. End 140 of brake blade 138 is accordingly moved away from its abutting relationship with the rim 130. In this manner, flange 100 is free to rotate in the unwinding direction allowing feed movement of fresh ribbon 12 from the supply spool 104. During ribbon feed movement, the ribbon 12 remains tensioned through its engagement with the capstan 108.

Upon discontinuation of operation of the ribbon drive mechanism 24, the take-up spool 74 is held fast by the saw-toothed disc 72 engaging the outer wrapping of ribbon 12 to prevent over-turning of the take-up spool 74. The releasable ribbon locking device 14 is returned towards the locking position through the pulling action of the spring 178, which re-engages blade 138 with rim 130 and, through arm 166, causes the capstan 108 to continually tension the ribbon 12 keeping it taut between the spools 74 and 104.

The flange 100 on supply spool support 98 is preferably molded from a plastic material and, although the metal brake blade 138 bears against the continuous rim 130 of flange 100 in the locking position, the pressing force exerted through the spring 178 is insufficient to noticeably distort rim 130. The present releasable ribbon locking device 14 is operable to afford stoppage of the supply spool support 98 for all amounts of ribbon feed and to continually apply a tensioning force on ribbon 12 in order to keep it taut at all times.

While the foregoing description has disclosed the releasable ribbon locking device 14 as including the brake blade 138 whose end 140 cooperates with the continuous rim 130 forming part of supply spool 104 to arrest the ribbon supply for all feed amounts, it will be clear to those skilled in the art that the exact shape of brake member 138 is not critical e.g., a brake pad would be equally applicable for arresting the continuous rim 130. Likewise, the disclosed coil spring 178 may be replaced by other biasing means for urging brake member 138 into abutting relationship with continuous rim 130. The presently disclosed embodiment is therefore to be considered in all respects as illustrative and not restrictive. Accordingly, the scope of the invention is defined by the appended claims rather than by the foregoing description. All changes which fall within the meaning and range of equivalency of the claims are therefore intended to be embraced therein.

What is claimed is:

1. A releasable ribbon locking device for use in a ribbon cartridge of the type removably mounted in a printing machine, the printing machine having a cartridge support and an actuable ribbon drive means, the cartridge including a housing, a ribbon, a ribbon supply spool having the ribbon wound thereon, a supply spool support mounted in the housing for rotation in an unwinding direction and having the ribbon supply spool rigidly mounted thereon, a ribbon take-up spool rotatably mounted in the housing, a ribbon feed mechanism located in the housing and operatively connected to the ribbon drive means when the ribbon cartridge is properly positioned on the cartridge support for printing, the ribbon feed mechanism tensioning the ribbon by winding spent ribbon onto the take-up spool in response to actuation of the ribbon drive means, and ribbon guide means in the housing for controlling movement of the ribbon from the supply spool to the take-up spool, the ribbon guide means including an exit and entrance opening in the housing for extending a portion of the ribbon external to the housing, the releasable ribbon locking device comprising:

(a) a flange on said supply spool support, said flange having a continuous peripheral rim;

(b) a locking member pivotally mounted in said housing, said locking member carrying a brake member movable therewith and positionable in abutting relationship with said rim;

(c) a lock release member pivotally mounted in said housing;

(d) means coupling said lock release member to said locking member, said coupling means comprising:
  (1) an arm on said locking member extending towards said lock release member;
  (2) a pin supported on said arm;
  (3) a first projection on said lock release member extending towards said locking member; and
  (4) a slot formed on said first projection closely receiving said pin for concomitant movement;
(e) spring means connected to said lock release member and urging said locking member toward said flange to position said brake member in said abutting relationship thereby preventing the unwinding rotation of the supply spool support; and
(f) a ribbon tensioning element supported on said lock release member and in engagement with a portion of said ribbon, said ribbon tensioning element operable to move towards said ribbon supply spool in response to take-up tensioning of said ribbon and through said coupling means said lock release member pivotally moves said locking member against the urging of said spring means for removing said brake member from said supply spool support rim.

2. A releasable ribbon locking device according to claim 1 wherein said brake member is a blade.

3. A releasable ribbon locking device according to claim 1 wherein said lock release member includes a second projection opposing said first projection, the second projection supporting said tensioning element.

4. A releasable ribbon locking device according to claim 3 wherein said tensioning element is a capstan rigidly supported on the second projection.

* * * * *